United States Patent [19]

Bailey et al.

[11] 4,355,626

[45] Oct. 26, 1982

[54] STOVE HAVING EXTRUDED DOOR OPENING AND METHOD OF MAKING SAME

[75] Inventors: Charles L. Bailey, Homer; Roy D. Baker, Brooklyn, both of Mich.

[73] Assignee: Eagle-Picher Industries, Inc., Cincinnati, Ohio

[21] Appl. No.: 288,310

[22] Filed: Jul. 30, 1981

Related U.S. Application Data

[62] Division of Ser. No. 163,923, Jun. 30, 1980, abandoned.

[51] Int. Cl.[3] ..... F23M 7/00

[52] U.S. Cl. ..... 126/190; 110/173 R

[58] Field of Search ..... 126/190, 198; 110/173 R, 179, 181; 52/785, 809

[56] References Cited

U.S. PATENT DOCUMENTS

| | | | |
|---|---|---|---|
| D. 249,890 | 10/1978 | Chinn et al. | 23/03 |
| 4,157,704 | 6/1979 | Zimmer | 126/197 |

FOREIGN PATENT DOCUMENTS

| | | | |
|---|---|---|---|
| 888145 | 7/1953 | Fed. Rep. of Germany | 126/190 |
| 716762 | 12/1931 | France | 126/190 |
| 551864 | 3/1943 | United Kingdom | 110/173 R |

*Primary Examiner*—Samuel Scott
*Assistant Examiner*—G. Anderson
*Attorney, Agent, or Firm*—Wood, Herron & Evans

[57] ABSTRACT

Door structure is provided for a wood-burning stove which is less susceptible to warping in use than a conventional flanged stove door opening. The door opening is formed by a process of cold drawing or extruding a rounded lip or flange which is integral with the stove front plate. Internal door structure provides angulation of the door with respect to the stove front plate.

9 Claims, 6 Drawing Figures

STOVE HAVING EXTRUDED DOOR OPENING AND METHOD OF MAKING SAME

This is a division, of application Ser. No. 163,923, filed June 30, 1980, now abandoned.

BACKGROUND OF THE INVENTION

The present invention pertains to wood-burning stoves of the type into which the fuel is charged through an opening having a door which is ordinarily closed during combustion. More particularly, this invention in one aspect pertains to a stove door opening structure, and a method of making it, whereby metal warping around the opening, which ordinarily tends to occur as the stove is repeatedly heated and cooled in use, is reduced.

An important concern in the design of a good wood-burning stove is the minimization of leakage between the combustion chamber in the interior of the stove, and the atmosphere outside the stove. There are two aspects of concern here: the major problem is to prevent combustion products, i.e., smoke and airborne ask, from escaping from the combustion chamber of the stove through the door opening into the surrounding room. Such stoves are usually placed in living quarters. The rate at which the wood is burned is controlled by regulating the amount of air entering the combustion chamber of the stove. This requires that an effective seal be maintained between the door and the door opening, to minimize air leakage into the combustion chamber. Without such a seal, excessive air can be drawn into the combustion chamber and will cause the wood to burn at an inefficient and undesirably fast rate.

In order to form a good seal between the stove door and the door opening, it is conventional to provide a front door opening having an outwardly projecting flange around the periphery of the opening in the stove front plate, which flange engages and bears tightly against a flexible gasket or seal on the inside of the door, and thereby minimizes leakage past the door when it is closed. In the past this flange has been formed by attaching separate metal strips by means of a continuous weld to the stove front plate so that they project outwardly around the opening. The outermost edges of the flange form the seal with a fibrous flame-resistant composition on the door inside face.

It has been observed, however, that when used over a period of time, such door opening flanges tend progressively to warp or bend as the stove is repeatedly heated and cooled in use, so that even though the flange edges lie in a common plane when manufactured, the original good edge seal is gradually lost thereafter and air and smoke can leak between the door and the flange. The door closures can sometimes be adjusted or realigned to correct the lost seal, but this is usually difficult and dirty, and may not be possible at all without special equipment.

In addition, the welding step previously required to secure or join the flange strips around the edges of the opening required substantial hand labor and, therefore, was quite expensive.

It is aesthetically desirable to have the outer surface of the stove door slope downwardly and outwardly with respect to the stove front. This has been accomplished, in prior art stoves, simply by providing tapering flanges, i.e., flanges of progressively increasing width or projection from the stove opening, so that the bottom door lies further away from the stove front than the top of the door, to provide the desired sloping appearance. However, by reason of the improved method of forming the flange of the present invention, the flange will generally be of uniform width around the entire opening. To compensate for this, door internal structure is provided whereby the desired outwardly sloping attitude of the door is nevertheless achieved.

Therefore, it is a primary object of this invention to form a flanged fuel opening for a stove, wherein the flange is less susceptible to warp when heated in use.

In addition, it is an object of this invention to form such a flange without the use of a welding step.

Furthermore, it is an objective of this invention to provide a door structure, and a method for forming it, wherein the door slopes outwardly and downwardly from the stove front, even though the door opening flange has a uniform width.

We have now found that flange warpage, which is caused by difference in thermal expansion rates between the long continuous weld and the metal of the stove, can be overcome by "extruding," i.e., drawing, the flange as an internal part of the stove front plate. This is done by forming an opening in the front plate which is smaller than the intended door opening and then extruding or drawing the metal outwardly around the periphery of the opening, to form the flange.

Figure 1:
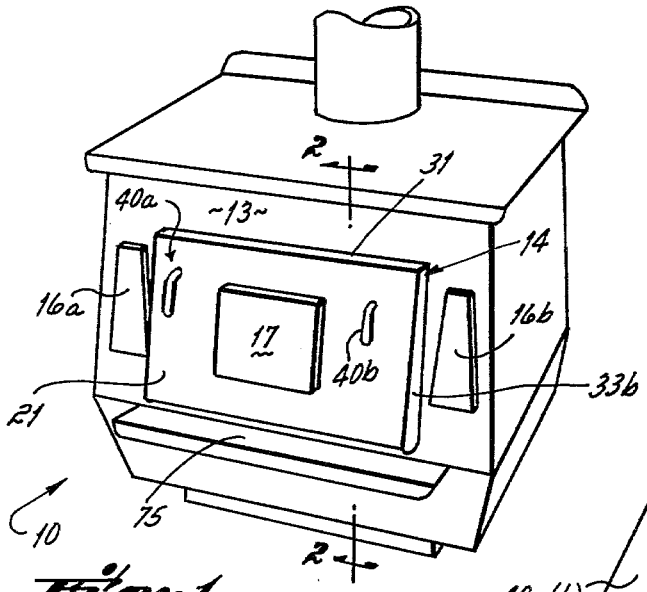
FIG. 1 is a perspective view of a stove having a door and door opening in accordance with a preferred embodiment of this invention.

By way of describing a typical environment of the invention, it is described with reference to a wood-burning stove shown at 10 in FIG. 1. Such stoves are made of heavy gauge sheet metal such as 10 gauge iron. Such stoves are fueled by manually placing wood or other combustible solids within the combustion chamber 11 of the stove (FIG. 2). For that purpose a fuel opening 12 is desirably located in a front wall or front plate 13 of the stove 10. In order to prevent smoke from escaping, and to prevent outside air from being drawn into the combustion chamber, this opening 12 is provided with a door 14 which is swingably attached to the stove front plate 13, by hinges 15*a* and 15*b* at its bottom edge, positioned to close over the opening 12.

Figure 2:
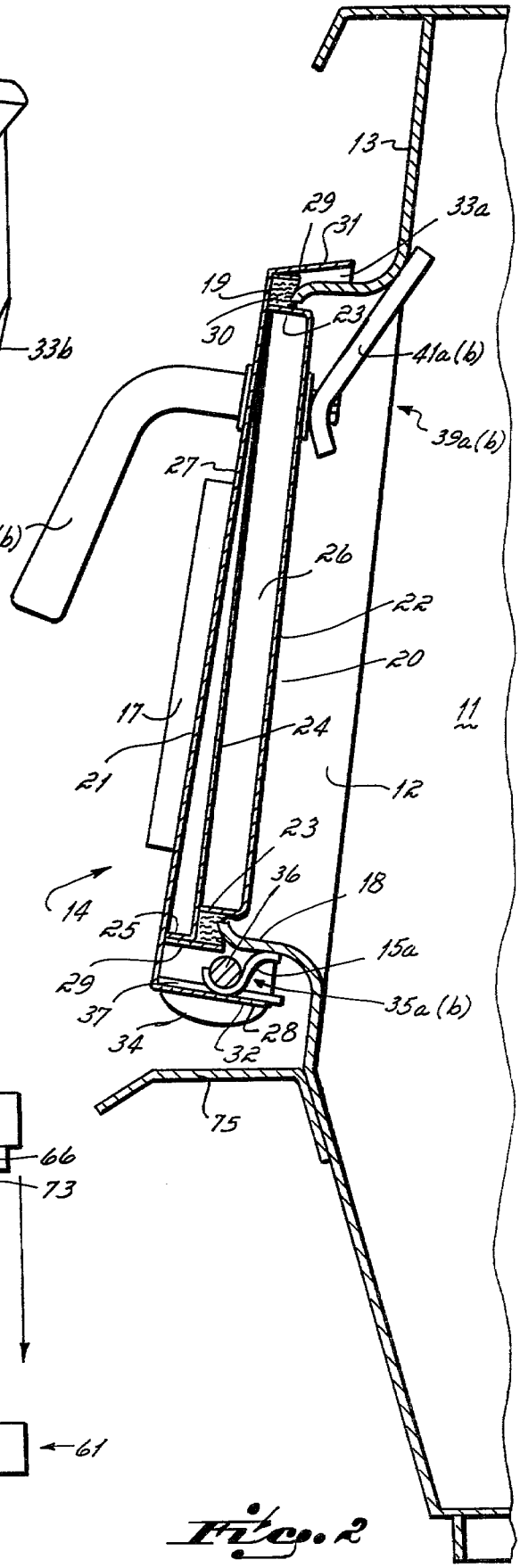
FIG. 2 is an enlarged vertical cross-sectional view, taken on line 2—2 of FIG. 1.
Figure 3:
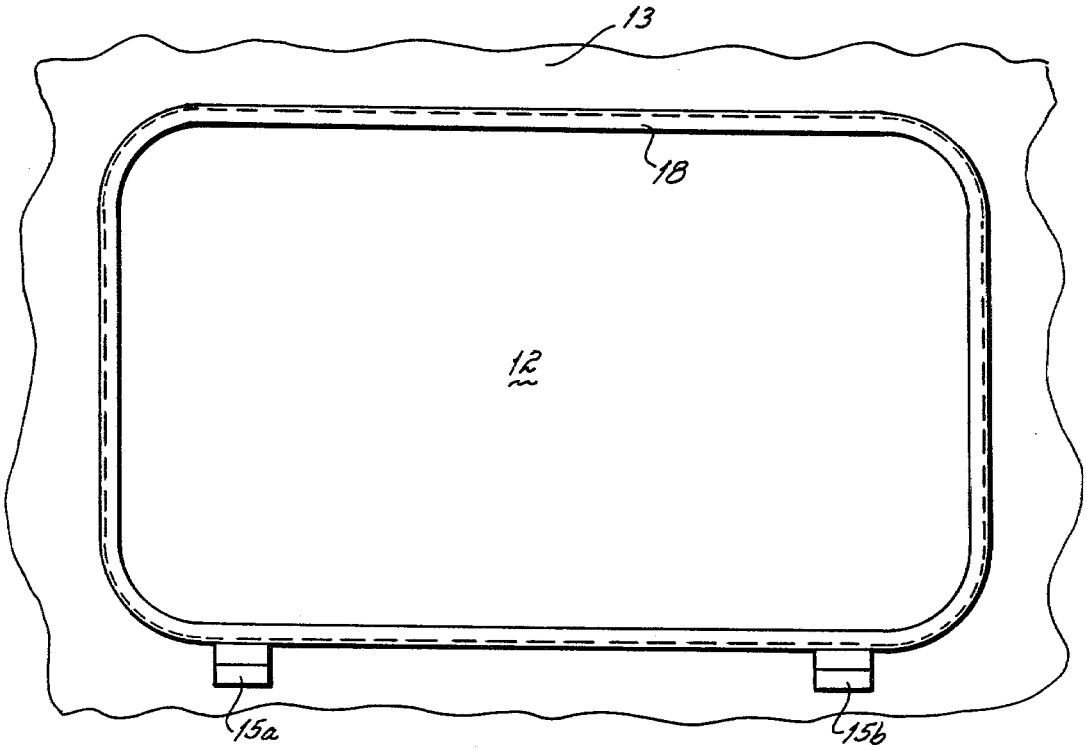
FIG. 3 is a fragmentary view of the stove door opening, with the door removed for clarity.

Also as seen in FIG. 1, the stove front plate includes a pair of adjustably closable heat outlets 16*a* and 16*b*, through which passages open the back of the combustion chamber, as known in the art. A solid ceramic piece 17 may be provided on the outside face of door 14 for decorative purposes, and for insulation.

In order to prevent the escape of smoke out the door opening, a seal around the opening 12 must be insured between the stove front plate and the door. This is accomplished by forming a flange 18 around the periphery of opening 12 and positioning a complimentary rope or gasket of fibrous or flexible sealing material 19 in the inside of door 14, i.e., facing the door opening. When the door is closed, the sealing material is pressed against the flange, thus forming the seal between the door and the opening.

The door comprises two basic sections, an inner section 20 which faces the combustion chamber, and an outwardly facing anterior section 21. The inner section 20 includes rounded or generally rectangular rims or flame plate 22 which has a bent (away from the stove face plate 13) lip portion 23 of uniform width around its periphery on all four sides. Section 20 also includes a rear or shim plate 24. Preferably plate 22 is made of a heavy gauge metal, e.g., 10 gauge iron. The shim plate 24 is rigidly attached, as by welding, to the edge of lip 23 which runs around plate 22. The uppermost edge of this shim plate 24 is flush with lip 23. However, the lower and side portions of the shim plate extend outwardly beyond the lip 23, and along its lower edge plate 24 has a forwardly tunred lip 25. As will be seen, this structure acts to "shim" or space the bottom portion of inner door section further outwardly from the stove face plate 13, than the top. This sloping appearance is desirable for aesthetic reasons. As will be described, the door inner section also provides a seat for the seal material 19.

Between the flame plate 22 and the shim plate 24, a dead air space 26 is provided. This acts as a heat barrier and helps prevent the front of the door from becoming excessively hot.

As can be seen from FIG. 2, when the door is mounted to the stove and is in closed position, the flame and shim plates 22 and 24 both lie parallel to stove front plate 13. As previously mentioned, it is desirable that the front of the door slope downwardly and outwardly from the stove front, which itself is angulated with respect to vertical. This is accomplished by the construction of the anterior portion of door 14.

Figure 4:
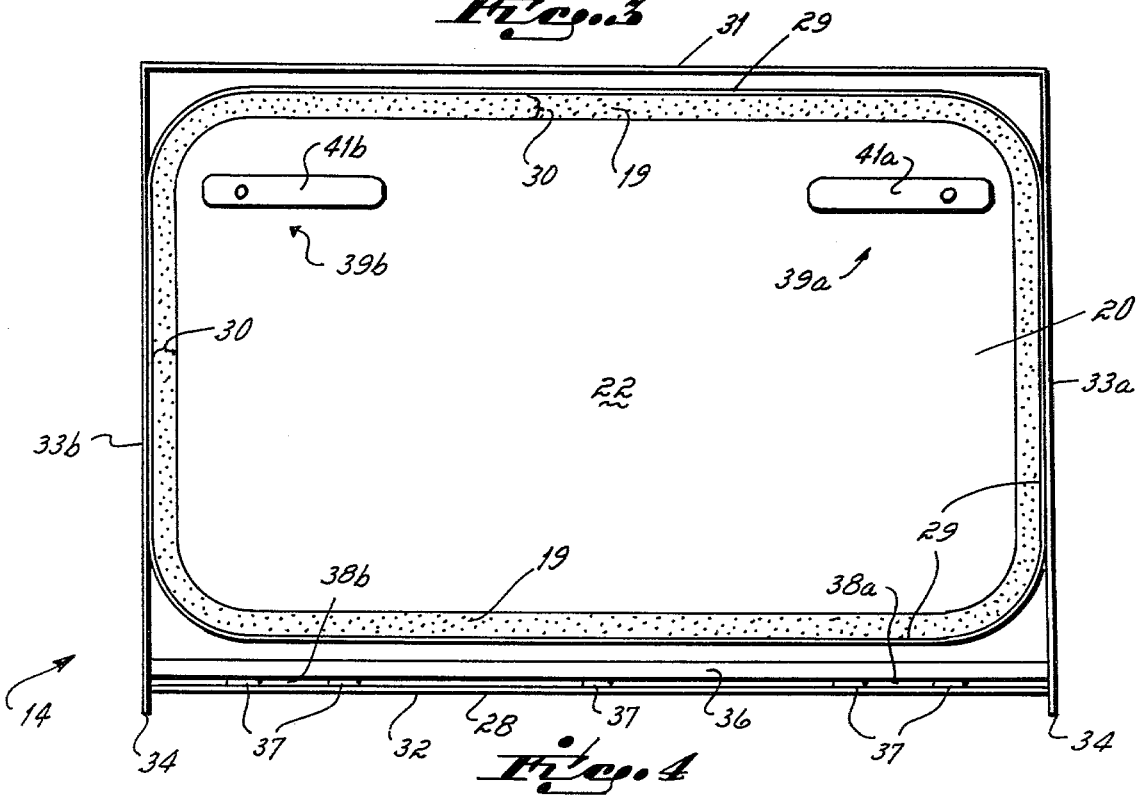
FIG. 4 is a view of the inside face of the stove door.

The anterior portion 21 of the door 14 is formed from an outer or face plate 27, which presents the outward surface of the door. Plate 27 has four rearwardly bent peripheral sides or lips 28. A series of flanges 29 (see FIG. 4) are secured to its inner face parallel to and just above the lower edge of plate 27. These flanges on the face plate outwardly surround the lip portion 23 of the flame plate 22, so that a channel 30 is defined between them (FIGS. 2 and 4). This channel 30 provides a seat for receiving a sealing gasket made of heat resistant flexible fibrous material such as fiber glass.

The outer edge or return 28 of plate 27 is integral with that plate and forms the four exterior sides of the door. Since the door is to taper outwardly and downwardly toward its lower section (see FIG. 1), the top portion 31 of this edge 28 is narrower than the bottom 32 thereof; and the side faces 33*a* and 33*b* of this edge taper from the relatively narrow upper edge 31 to wider bottom edge 32. The lower corners 34 of the side portions 33*a* and 33*b* are rounded, see FIG. 2, so as not to interfere with the hinged movement of the door. In addition, upper edge 31 extends upwardly at an obtuse angle so as to provide clearance for the door opening flange 18.

The door is hingedly mounted to the stove front as by two S-shaped hinges 35*a* and 35*b* at its lower side, see FIG. 2, which are secured to the underside of the door flange 18. A hinge pin 36 which forms the complimentary receiving means for these hinges 35*a* and *b* is mounted to door face plate 27 spaced from its bottom edge 32, by a series of spacing plates 37. The spacing plates 37 are in turn welded to and above the bottom edge 32 of front plate 27 (FIGS. 2 and 4). These spacing plates are spaced apart sufficiently that spaces 38*a* and 38*b* are provided between them to receive S-shaped hinges 35*a* and 35*b* in mounting the door to the stove.

Preferably a metal strip 75 is welded below the opening 12 and hinges 35*a* and 35*b*. This acts to stop the door from rotating 180° when opened.

When mounted, the door can be locked tightly closed by a pair of latches 39*a* and 39*b*, FIG. 4, which are rotatably mounted to the door. The latch handles 40*a* and *b* on the front of the door have inner ends which are rigidly attached to camming tongues 41*a* and 41*b*, FIGS. 2 and 4 on the door inside. When the door is closed, the handles 40*a* and *b* are turned to bring their camming tongues against an interior portion of the stove front plate 13, thereby to draw the door against the front plate, or more particularly, to press the sealing strip 19 against the flange 18 which surrounds opening 12.

As long as the flange 18 is true, i.e., so long as its front edges around the opening lie in a common plane, an effective seal can be formed to prevent smoke escaping from the combustion chamber into the surrounding environment, and to prevent ambient air from entering the combustion chamber. However, we have found that whether the lip of the flange does in fact remain straight when the stove is repeatedly heated and cooled in use is dependent upon the structure of the flange itself. As stated earlier, prior art methods called for making the flange by attaching separate strips around the periphery of the opening by means of a long continuous weld. This had the advantage of facilitating the desired outward slope of the door; the door slope could be established simply by tapering the flanges so that they were wider at the bottom than at the top. However, as the stove becomes heated and cooled petetitively, thermal stresses caused by difference in the rates of thermal expansion of the two different materials, i.e., the metal of the stove and the weld material, caused the flanges to move, since the flange and the weld were continuous, the moving metal pressed against adjacent metal thus causing the flange to warp. The seal was thereby lost.

We have discovered that, surprisingly, a seal of substantially better integrity can be provided by a flange 18 which is drawn (or "extruded") integrally from the front plate, and which has a rounded-over inner edge. In accordance with the new method, the flanged opening 12 to the combination chamber 11 of the present invention is formed in a two-step method, whereby differential thermal expansion-caused warpage is substantially reduced. The initial step comprises cutting a hole in the metal sheet 42 (FIG. 5), which is intended to be the front plate of the stove. The plate 42 should be slightly larger in the outer diameter than the desired size of the final front plate, to allow for metal flow as the flange is subsequently formed.

Figure 5:
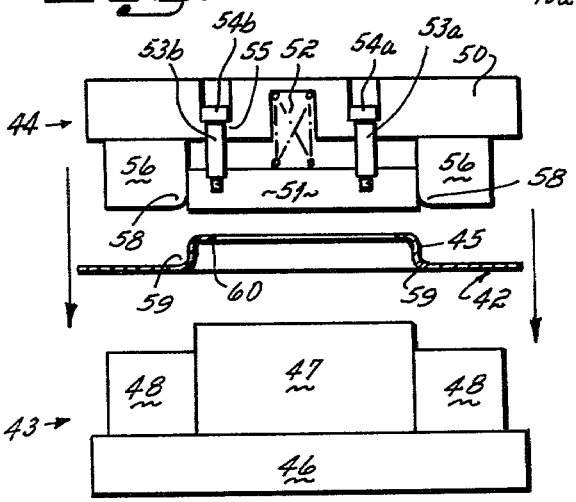
FIG. 5 is a cross-sectional exploded view of opposed dies for extruding or drawing the stove door opening in accordance with a preferred embodiment of the method of this invention, with the flanged stove front plate in position between the die halves.

To form the flange 18, the apertured front plate 42 is then positioned between a male mold member or drawing die punch 43, and an opposed, relatively movable female or extrusion die 44. The outer edges of the plate are gripped or clamped by means known in the art, to restrain deformation around the flange. The metal of plate 42 around the initial hole is then extruded or drawn by punch 43 into opposing mating die 44 to form an intermediate flange 45. FIG. 5 shows the plate 42 between the two die lathes 43 and 44, after the intermediate flange has been formed. The initial aperture must be small enough to provide sufficient material around it to form the flange, and large enough so that the central area of metal not used in the flange does not restrict the flow and thereby cause the flange to warp or crack. This, of course, will vary depending upon the desired size of the flange and the desired size of the hole within the front plate. For an opening $9\frac{3}{8}\times15\frac{3}{8}''$ with a 1.4" deep flange, the opening in 10 gauge iron should be about 7×13 9/32" and for an opening 11 9/16×19" and a 1.4" deep flange, the opening in 10 gauge iron should be about $9\frac{3}{8}\times16$ 13/16".

Male mold 43 preferably comprises a stationary platen 46 mounting a raised stop portion 47 and a surrounding lower press section 48. The lower press section 48 extends around the stop section 47. The differences between the relative heights is dependent upon the intended width or depth of flange 45.

The female or movable die section 44 includes two components both carried by a base plate 50. A yielding center portion 51 is biased downwardly from base section 50 by means of spring 52 and is restrained in the rest position shown in FIG. 5 by means of bolts 53*a* and 53*b* which move freely through the base section 50 until heads 54*a* and 54*b* are arrested by an upwardly facing surface 55 of base 50. In addition, a non-yielding portion 56 is provided around the periphery of yielding section 51, aligned to cooperate with the lower press section 48.

In the drawing method, the precut front plate 42 is positioned so that the aperture is centered on stop section 47. Since the hole is smaller than the stop section, an annular area will rest on the stop section. The female die member 44 is forced toward the male die member 43 by conventional press means, not shown, and contacts the front plate.

Upon the application of additional force, the non-yielding section 56 advances relative to the yielding section 51, which presses the edge of the aperture area on stop section 47. This forces the metal plate downwardly relative to the portion on stop section 47, thereby forming the upstanding frame around the stop section of the press, inwardly of die portion 56. This ridge of metal is the intermediate flange 45, which is subsequently trimmed to final shape. The corners 58 of die member 56 are rounded and thereby form rounded corners as at 59 where the flange leads from the plate 42. This provides a strong, clean appearance to the door opening flange.

Figure 6:
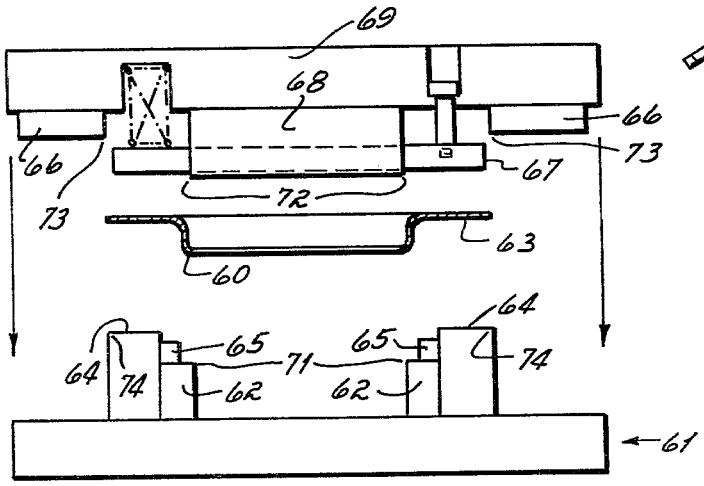
FIG. 6 is a cross-sectional exploded view of two spaced apart, opposed dies for edge turning and cutting the door opening flange, with a flanged stove front plate in position between the dies.

At the top (as seen in FIG. 5) of flange 45 is an annulus of metal 60 which lodged between the yielding section 51 of the female die 44 and the stop section 47 of the male die section 43. Since the edge or tip of the flange is intended to form a seal with a flexible seal material, it is preferable that the flange have an angulated or beveled edge to press into the seal material. In addition, metal must be removed from around the periphery of plate 42, to remove "grip" areas and to size it. Therefore, a punch press step is next employed, as shown in FIG. 6, to trim off excess metal around the outer edge and in the center. The intermediate front plate 42, as formed by the drawing operation, is positioned over a lower press member 61 with the flange annulus 60 resting on an inner cutting portion 62 of die 61 and a peripheral or side portion 63 of the metal plate resting on an upper section 64 of die 61. An annular support section 65 which is of larger inside dimension than the cutting portion 62 is seated on the top side of cutting section 62 inwardly of the upper section 64. This provides inward support around flange 45 during the following cutting step. The upper press member 65 comprises an annular outer non-yielding section 66, an intermediate annular yielding section 67 and a rectangular inner non-yielding section 68 which are all supported from a movable platen 69. Yielding section 67 is spring biased downwardly (as seen in FIG. 6) so as to yield upon the application of sufficient force.

The upper and lower die members provide two pairs of complementary cutting edges. Inner cutting edges are formed by and between the inner edge 71 of cutting die section 62 of lower die member 61, and a complementary cutting edge is formed by the outer edge 72 of the inner non-yielding portion 68 of upper die member 65. These cutting edges trim the excess material off flange 45 to form a sharp straight edge.

A second pair of cutting edges is formed by an inner edge 73 of the outer, non-yielding, section 66 on the upper die member 61. With the second complementary cutting edge 74 being formed at the outer edge of the upper section 64 of the lower die member 61. These cutting edges trim the center and the periphery of the front plate to bring the metal to its desired size.

In operation, upper die member 65 is pressed downwardly until the yielding section contacts area 63, of the frong plte, which is resting on the upper section 64 of the lower die member. As the downward force is increased, the non-yielding inner and outer sections 68 and 66 trim off the excess metal which extends beyond the respective cutting edges. This forms a well-defined edge on the flange as well as a neat edge on the periphery of the front plate. It will be seen that this technique is limited to forming flanges of uniform depth, which would not correspond to the "slanting" look that is desired. It is for this reason that the shim aspect of the door structure is provided.

This method of forming a door and flanged opening enables one to make a wood burning stove which is aesthetically pleasing and which forms an efficient seal which does not warp when used.

Therefore, having specifically described our invention, we claim:

1. Door and door opening structure for wood-burning stove, the door opening structure comprising, a stove front plate having a fueling opening in it, a door flange projecting fowardly around the opening, the flange being integral with the plate, there being a round corner where the flange joins the plate;

the flange having an inturned lip at its outer edge, the door comprising, an outer plate, an inner plate, and a shim plate, said shim plate being connected between the outer and inner plates and providing spacing between them, wherein said spacing increases from the top to the bottom of said inner and outer plate, and wherein said shim plate at an upper edge portion thereof adjoins the outer plate and at a lower edge portion thereof has an outwardly turned lip mounted to said outer plate and which angulates said shim plate with respect to the outer plate, there by defining said spacing between the inner and outer plates, said inner plate being mounted to said shim plate and being angulated by the shim plate with respect to said outer plate.

2. The structure of claim 1 wherein said flange is weld-free.

3. The structure of claim 1 wherein said flange is drawn from said stove front plate and completely surrounds said opening.

4. The structure of claim 3 wherein said flange projects uniform distance from said plate around said opening.

5. The structure of claim 4 wherein said opening is generally rectangular with rounded corners.

6. A stove door as claimed in claim 1, wherein said inner plate has an outer peripheral edge, a seal-receiving channel is provided along said outer edge, and a sealing gasket is seated within said channel.

7. A stove door as claimed in claim 1, including a latching means comprising one or more camming tongues rotatably mounted to said door by means of one or more handles.

8. The structure of claim 1 wherein said spacing defines an air space which provides a heat barrier between said inner and outer plates.

9. The structure of claim 6 wherein said channel is defined around said inner plate, and said inner plate projects into said fueling opening.

* * * * *